US005664285A

United States Patent [19]

Melito et al.

[11] Patent Number: 5,664,285

[45] Date of Patent: Sep. 9, 1997

[54] VACUUM CLEANER WITH COMBINED FILTER ELEMENT AND COLLECTION UNIT

[75] Inventors: M. Anthony Melito, East Haven; Anthony Brooks Rorke, Guilford, both of Conn.; Anthony J. Abbott, Easley, S.C.

[73] Assignee: Black & Decker Inc., Newark, Del.

[21] Appl. No.: 584,650

[22] Filed: Jan. 11, 1996

[51] Int. Cl.[6] ..... A47L 9/10; A47L 9/20

[52] U.S. Cl. ..... 15/352; 15/347; 55/427; 55/429; 55/DIG. 3

[58] Field of Search ..... 15/347, 349–352; 55/426, 427, 429, DIG. 3

[56] References Cited

U.S. PATENT DOCUMENTS

| | | | |
|---|---|---|---|
| 1,476,004 | 12/1923 | Orr . | |
| 1,965,614 | 7/1934 | Sellers . | |
| 2,017,893 | 10/1935 | Boettler . | |
| 2,064,587 | 12/1936 | Carlstedt | 55/DIG. 3 |
| 2,272,814 | 2/1942 | Olson . | |
| 2,330,621 | 9/1943 | Radke . | |
| 2,337,936 | 12/1943 | Sellers | 55/429 |
| 2,375,331 | 5/1945 | Taylor . | |
| 2,416,417 | 2/1947 | Taylor . | |
| 2,416,418 | 2/1947 | Taylor . | |
| 2,416,419 | 2/1947 | Pickford . | |
| 2,475,808 | 7/1949 | Storm, Jr. . | |
| 2,482,166 | 9/1949 | Gage . | |
| 2,564,339 | 8/1951 | Nerheim . | |
| 2,592,710 | 4/1952 | Kirby . | |
| 2,618,007 | 11/1952 | Fuller . | |
| 2,648,396 | 8/1953 | Kirby . | |
| 2,916,104 | 12/1959 | Hultberg et al. | 55/DIG. 3 |
| 3,040,366 | 6/1962 | Vance . | |
| 3,618,158 | 11/1971 | Worwag | 15/349 |
| 3,621,640 | 11/1971 | Ohno et al. . | |
| 3,758,914 | 9/1973 | Nupp et al. . | |
| 3,914,820 | 10/1975 | Hankel . | |
| 4,276,070 | 6/1981 | Hug | 55/429 |
| 4,426,211 | 1/1984 | Ataka et al. . | |
| 4,523,936 | 6/1985 | Disanza | 55/DIG. 3 |
| 4,617,034 | 10/1986 | Ikezaki et al. | 55/DIG. 3 |
| 4,745,654 | 5/1988 | Yamamoto et al. . | |
| 5,020,186 | 6/1991 | Lessig, III et al. . | |
| 5,115,538 | 5/1992 | Cochran et al. . | |
| 5,135,552 | 8/1992 | Weistra | 55/DIG. 3 |

FOREIGN PATENT DOCUMENTS

| | | | |
|---|---|---|---|
| 2142254 | 3/1973 | Germany | 15/347 |
| 54-99355 | 8/1979 | Japan | 55/DIG. 3 |

*Primary Examiner*—David Scherbel
*Assistant Examiner*—Terrence Till
*Attorney, Agent, or Firm*—Barry E. Deutsch

[57] ABSTRACT

A vacuum cleaner with a removable collection module. The module has a combined collection assembly and filter element. The collection assembly has a one-piece frame and a cover attached to an open rear end of the frame. The filter element is permanently attached to the cover on an interior side. The cover has ribs that space the filter element from a rear side of the cover and form an air flow space between the filter element and the cover. The cover is mounted on a flange of the frame with a frictional airtight connection.

18 Claims, 8 Drawing Sheets

VACUUM CLEANER WITH COMBINED FILTER ELEMENT AND COLLECTION UNIT

BACKGROUND OF THE INVENTION

1. Field of the Invention

The present invention relates to vacuum cleaners and, more particularly, to a combined filter element and collection unit.

2. Prior Art

U.S. Pat. No. 4,745,654 discloses a vacuum cleaner with a paper filter that is held between a filter holder and a dust case. U.S. Pat. Nos. 5,020,186 and 5,115,538 disclose a vacuum cleaner with a dust container and a filter bag with a supporting frame removably sealed in place by peripheral gaskets. U.S. Pat. No. 3,758,914 discloses a vacuum cleaner with a removable dirt box having a handle. U.S. Pat. No. 4,426,211 discloses a vacuum cleaner with a dust collector having a handle and two filters. The secondary filter forms an end closure for the collector. Other relevant U.S. Patents include U.S. Pat. Nos. 3,914,820; 2,564,339; and 3,621,640.

SUMMARY OF THE INVENTION

In accordance with one embodiment of the present invention in a vacuum cleaner having a housing, a motor located in the housing, an impeller connected to the motor, and a debris collection unit removably connected to the housing, the improvement comprises the collection unit having a frame, a cover and a filter element. The cover is removably connected to the frame to substantially close an open side of the frame. The cover has an exit aperture therethrough. The filter element is permanently connected to an inside surface of the cover over the exit aperture.

In accordance with another embodiment of the present invention a vacuum cleaner collection cup assembly is provided comprising a frame, a cover, and a filter element. The frame forms a receiving area and has a generally open rear end. The cover is substantially planar and is connected to the rear end of the frame. The cover substantially closes the rear end of the frame and has an exit aperture therethrough. The filter element is flat and is connected to an interior side of the cover. The filter element is spaced from a rear wall of the cover by spacer ribs of the cover such that air can travel through the filter element into a space between the filter element and the rear wall of the cover and through the space to the exit aperture in the cover.

In accordance with another embodiment of the present invention a vacuum cleaner is provided comprising a housing, a motor, an impeller, and a collection module. The motor is located in the housing. The impeller is connected to the motor. The collection module is removably connected to the housing. The module has a combined collection assembly and filter element. The collection assembly has a frame with an entrance and a cover connected to the frame. The cover has an air exit therethrough and the filter element is permanently connected to an inside of the cover and covers the air exit. The filter element is spaced from a rear wall of the cover to form an open space between the filter element and the rear wall of the cover.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
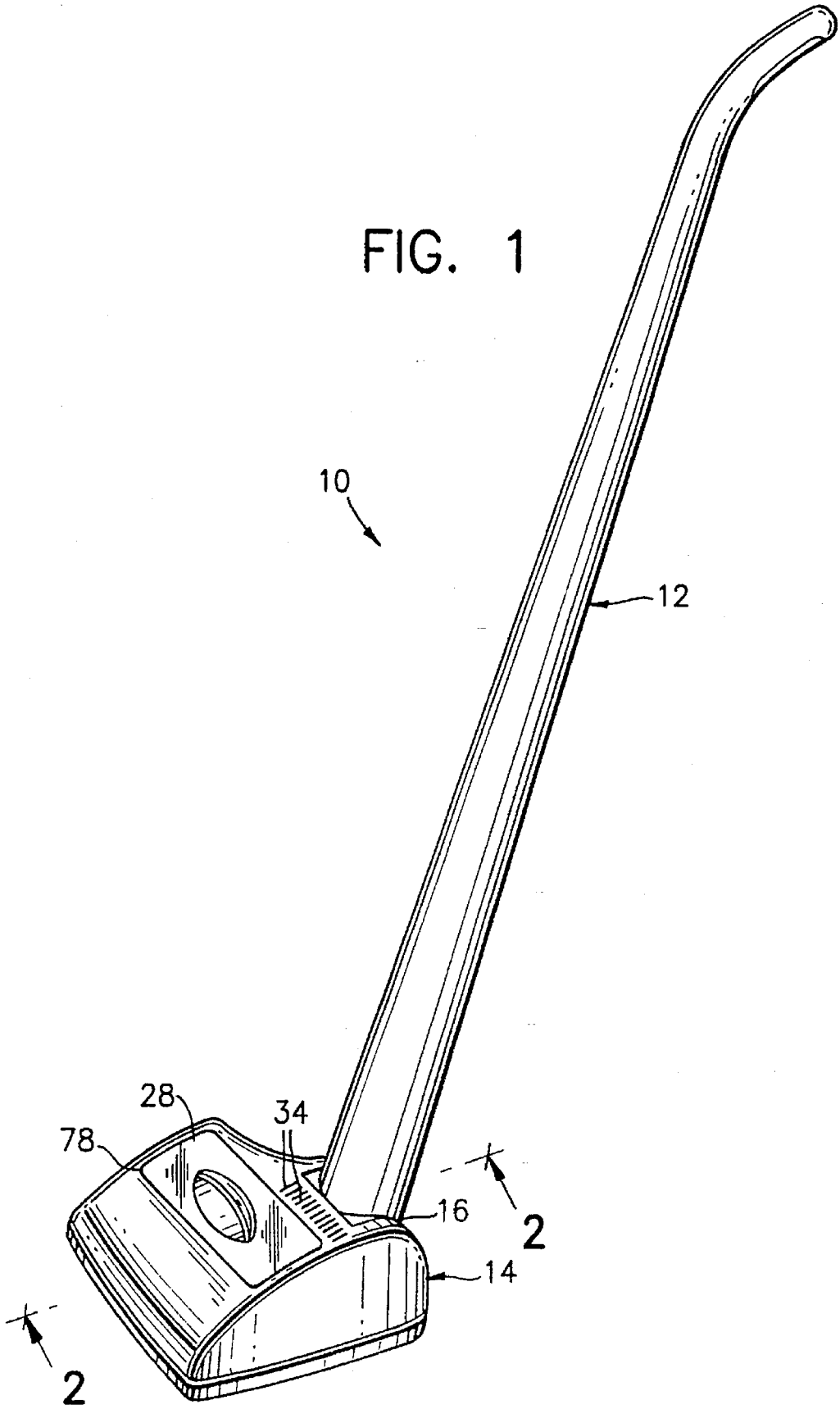
FIG. 1 is a perspective view of a vacuum cleaner incorporating features of the present invention.

Referring to FIG. 1, there is shown a perspective view of a vacuum cleaner 10 incorporating features of the present invention. Although the present invention will be described with reference to the embodiments shown in the drawings, it should be understood that the present invention may be incorporated into various different types of alternate embodiments. In addition, any suitable size, shape or type of elements or materials could be used.

Figure 2:
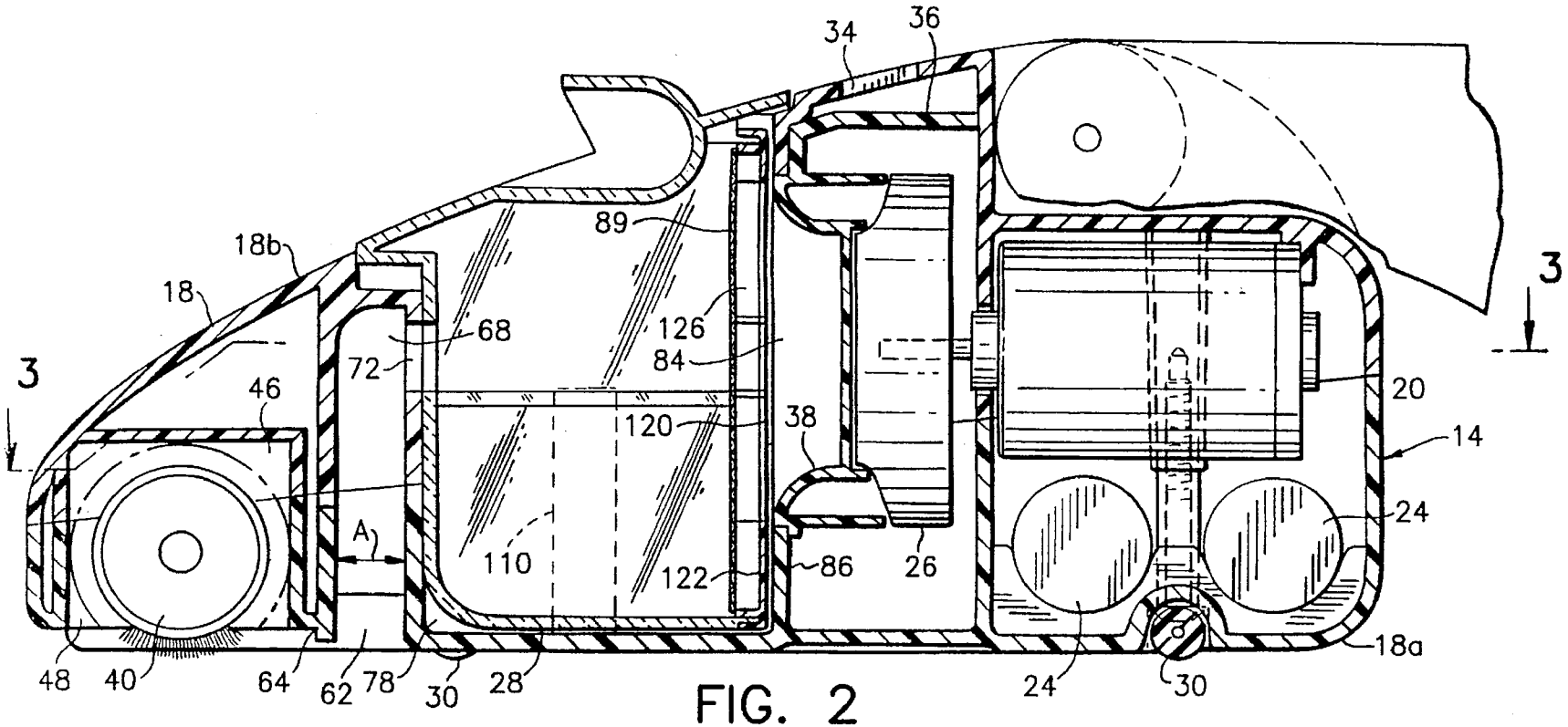
FIG. 2 is a cross sectional view of the floor traversing unit of the vacuum cleaner shown in FIG. 1 taken along line 2—2.
Figure 3:
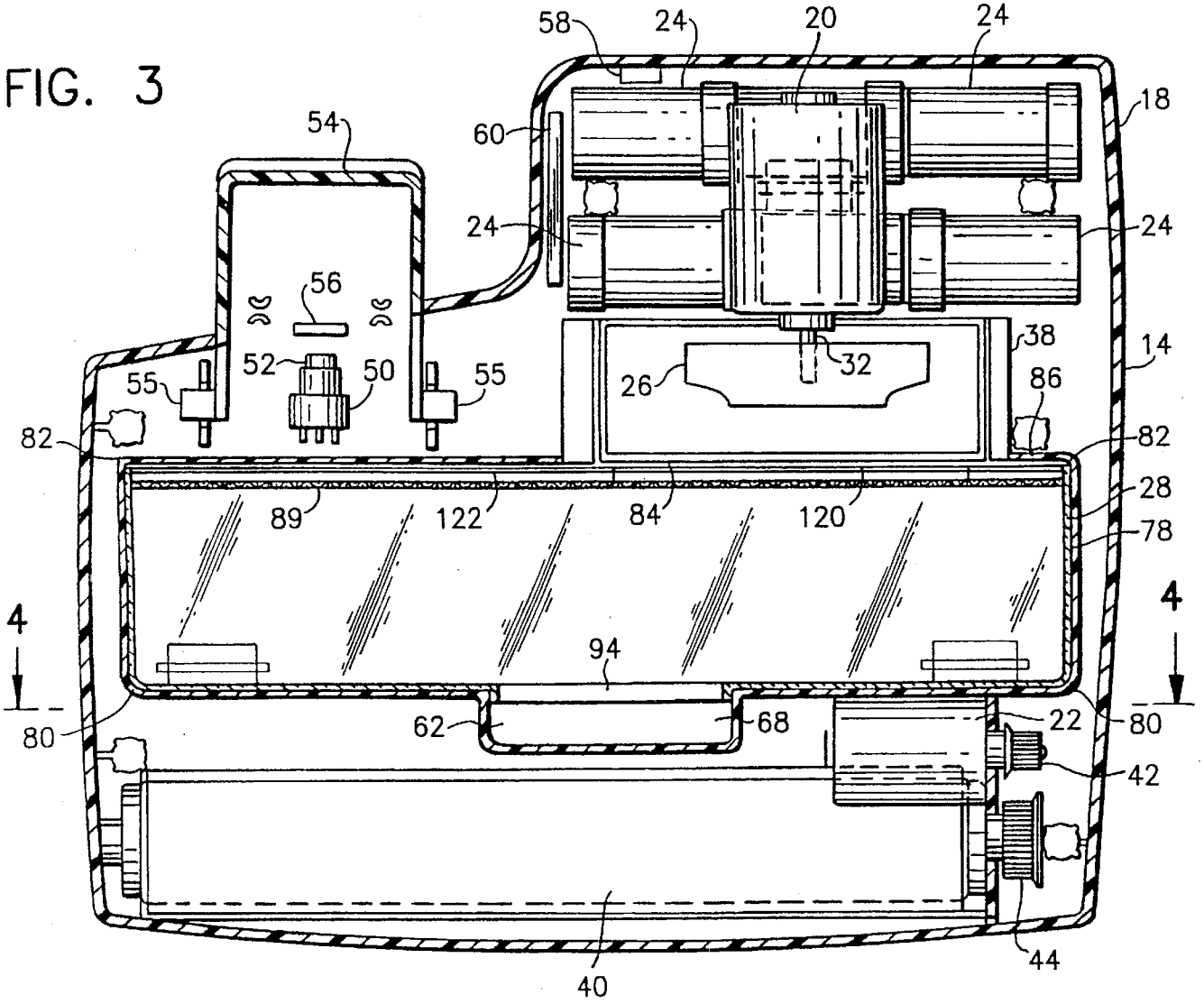
FIG. 3 is a cross sectional view of the unit shown in FIG. 2 taken along line 3—3.

The vacuum cleaner 10 generally comprises a handle 12 and a floor travelling head or unit 14. It should be noted, however, that features of the present invention could be incorporated into any suitably shaped or configured vacuum cleaner. In the embodiment shown, the handle 12 is preferably made of plastic or polymer material and is pivotably connected to the head 14 at pivot location 16. Referring also to FIGS. 2 and 3, the head 14 generally comprises a housing 18, a primary fan motor 20, a secondary brush motor 22, batteries 24, an impeller or fan 26, and a collection unit or assembly 28. The housing 18 is preferably made of plastic and has wheels or rollers 30 connected to its bottom (see FIG. 3A). The housing 18 is preferably comprised of two general clamshell housing members; a top member **18*b* and a bottom housing member 18*a*. The two housing members are connected to each other to enclose the motors, batteries and impeller therebetween and form substantially the entirety of the housing 18. The primary motor 20 is fixedly connected to the housing 18 and has a drive shaft 32** extending from its front.

The impeller 26 is connected to the drive shaft 32. The housing 18 has air exit slots 34 in its top surface, as seen in FIG. 1, to allow air, which is moved by the impeller 26, to exit the housing 18. The vacuum cleaner 10 has a diffuser or air direction shell 36 that is connected to the housing 18. The air direction shell 36 surrounds the impeller 26. In a preferred embodiment the air direction shell 36 is molded integrally with top and bottom housing members **18*a*, 18*b* that form the housing 18. The air direction shell could be a separate member that is mounted inside the housing. The shell 36 has a general expanding spiral shape and includes an inlet portion 38. The venturi or inlet portion 38 has a general funnel shape. The impeller 26 is a centrifuge fan blade. Air entering through the inlet portion 38 is pushed outward into the air direction shell 36 and out the air exit slots 34**.

The second motor 22 is connected to the housing 18 in a front part of the housing. The second motor 22 is connected to a rotatable brush 40 at the front of the housing by a transmission belt (not shown). The transmission belt (not shown) operably connects the motor 22 to the brush 40 by being mounted on the two drive sections or pulleys 42, 44. When the second motor turns the drive section 42, the transmission belt is moved. The transmission belt turns the drive section 44 which, in turn, rotates the brush 40. However, any suitable type of brush drive system could be provided. Alternatively, the rotating brush need not be provided. The brush 40 is rotatably connected to the housing 18 in a pocket 46. The pocket 46 is totally enclosed except for an opening 48 at the bottom of the pocket 46. An end of the brush 40 extends through an opening in a lateral side of the pocket 46. The bristles of the brush 40 extend out of the bottom opening 48 and past the bottom of the housing 18.

The batteries 24 comprise six rechargeable batteries. However, features of the present invention could also be used in a vacuum cleaner that is not battery powered. The batteries 24 are fixedly connected to the housing 18 below and on opposite sides of the first motor 20. Because the batteries are rechargeable, the vacuum cleaner also has an electrical socket 58, for connection to a recharger, and a printed circuit board 60 connecting the socket 58 to the batteries 24. The batteries 24 are electrically connected to the two motors 20, 22 by a three position switch 50. The switch 50 has a first OFF position and two ON positions. The two ON positions include a first ON position wherein only the first motor 20 is supplied with electricity and a second ON position wherein both motors 20, 22 are supplied with electricity. The switch 50 has an actuation plunger 52. Pivotably mounted at the rear of the housing 18 is a spring biased foot pedal 54. The foot pedal 54 is mounted by pivot section 55 to the housing. The foot pedal 54 has a section 56 that is located to depress the actuation plunger 52 when the foot pedal 54 is depressed. However, any suitable type of control mechanism could be provided.

Figure 3A:
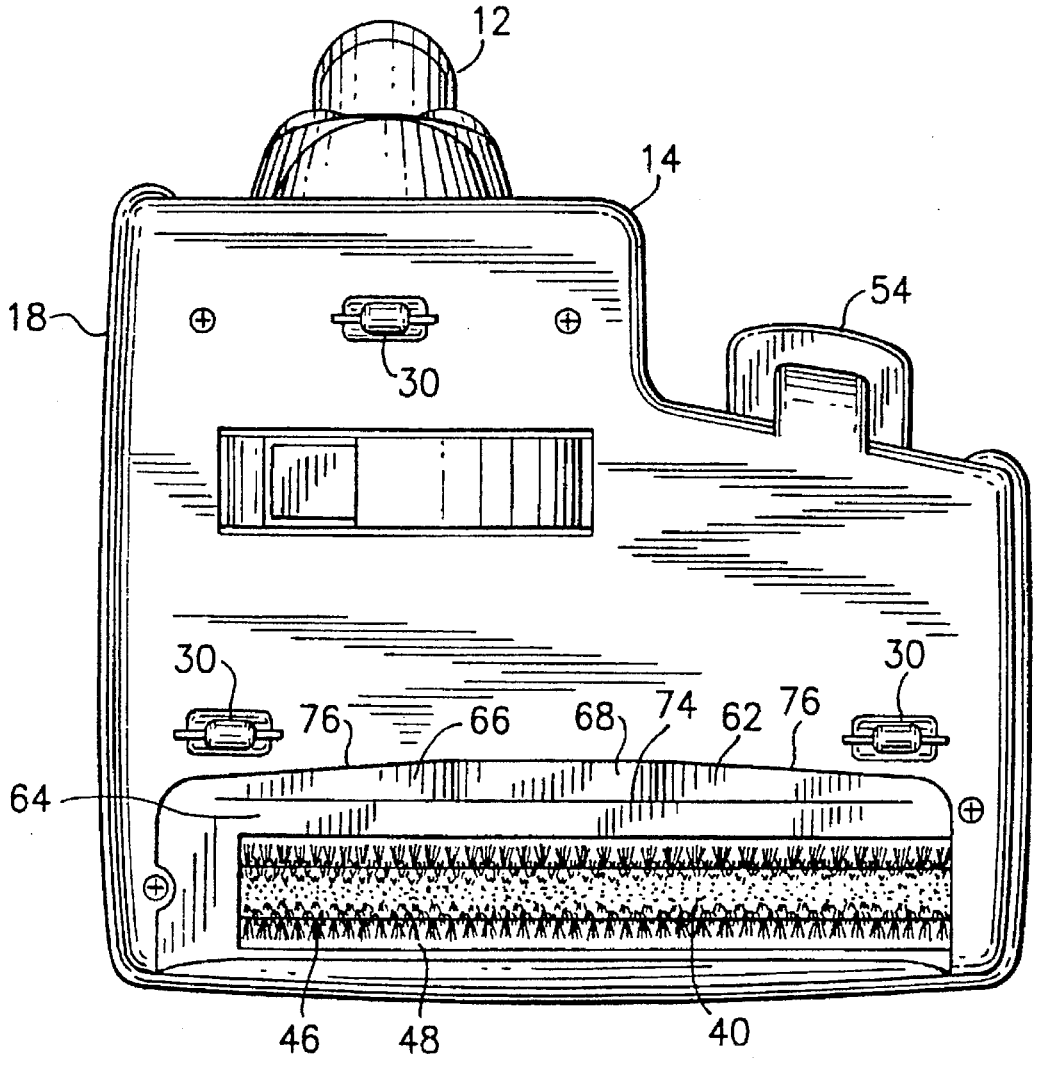
FIG. 3A is a bottom plan view of the vacuum cleaner shown in FIG. 1.
Figure 4:
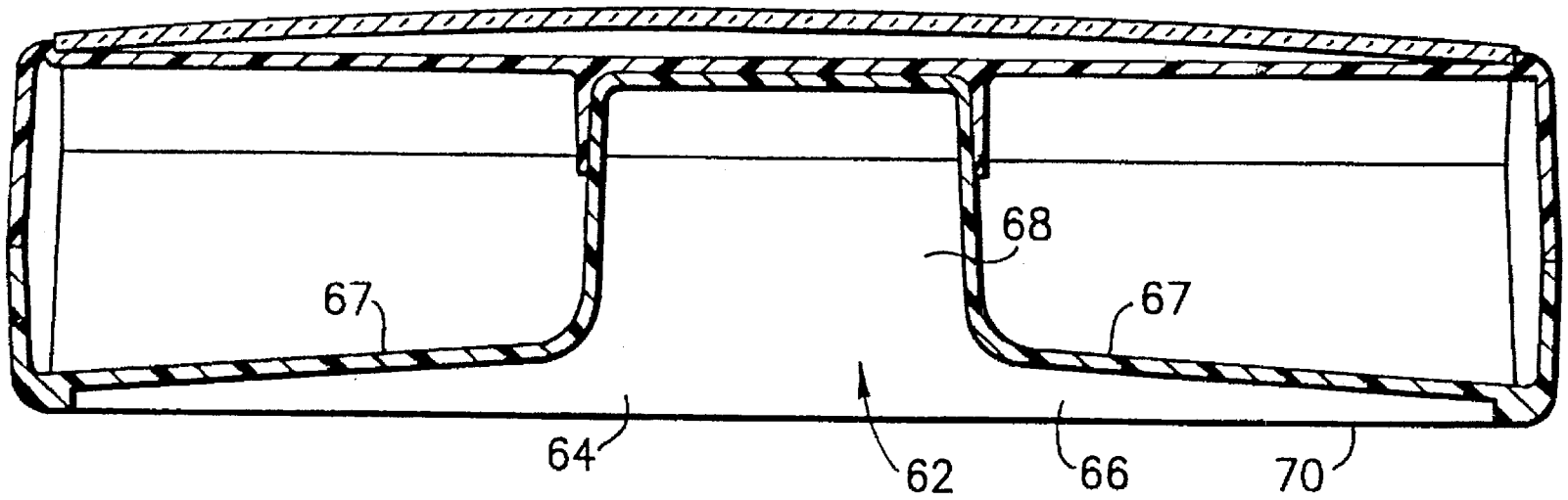
FIG. 4 is a cross sectional view of the unit shown in FIG. 3 taken along line 4—4.
Figures 5, 6, 7:
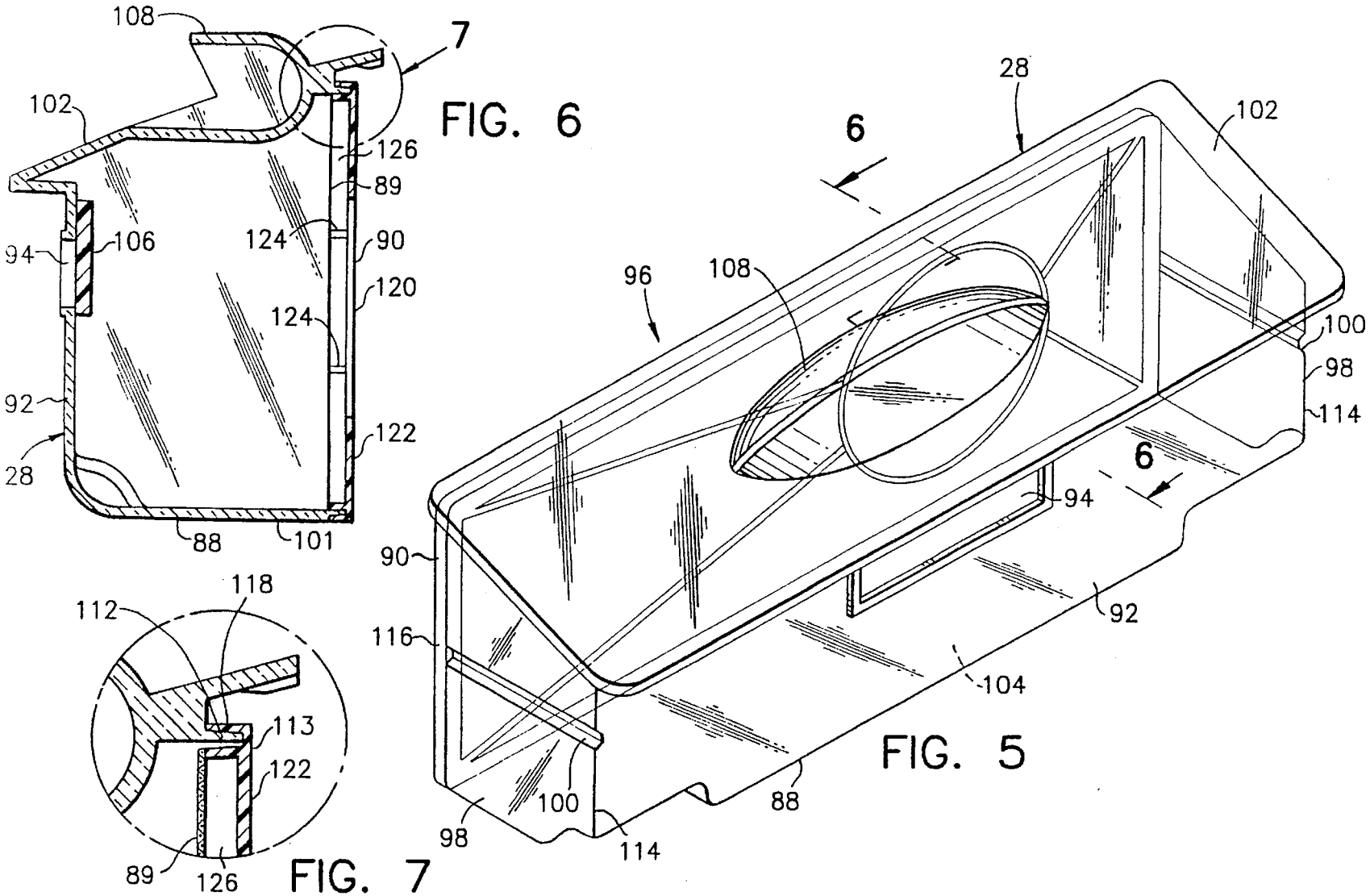
FIG. 5 is a perspective view of the collection unit used in the vacuum cleaner shown in FIG. 1.
FIG. 6 is a cross sectional view of the collection unit shown in FIG. 5 take along line 6—6.
FIG. 7 is an enlarged view of area 7 shown in FIG. 6.
Figure 8:
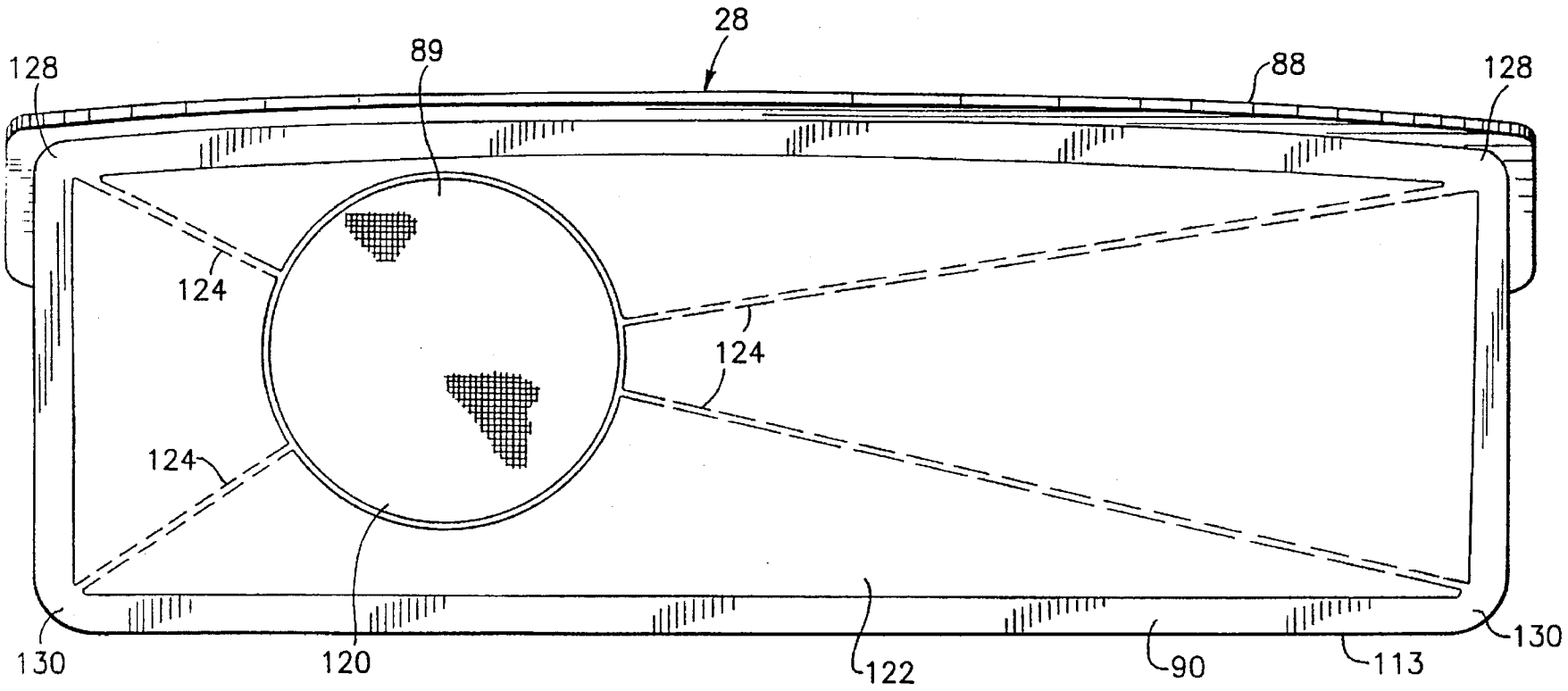
FIG. 8 is an elevational rear view of the collection unit shown in FIG. 5.

Referring also to FIG. 4, located behind the pocket 46 is a suction inlet 62. The inlet 62 is separated from the pocket 46 by a wall 64 as seen in the bottom plan view of FIG. 3A. The inlet 62 has a first lower section 66 and a second upper section 68. The two sections 66, 68 have a relatively narrow length A from front to back as seen in FIG. 2. The lower section 66 has a wide bottom aperture 70 that extends across almost the entire width of the housing 18. As seen in FIG. 4, the top walls 67 of the lower section 66 tapers downwardly as they extend laterally outwardly from the upper section 68. As seen in FIG. 3A, the front wall 74 of the lower section 66 is straight. However, the rear wall of the lower section 66 has sections 76 that taper towards the front wall 74 as they approach the lateral sides of the unit 14. The upper section 68 has an aperture 72 at its top for air and debris to travel into the collection unit 28.

The housing 18 has a hole 78 that extends into its top surface for removably receiving the collection unit 28. The hole 78 has a general rectangular block shape. As seen in FIG. 3, the hole 78 has two front corners 80 and two rear corners 82. The front corners 80 have a larger radius of curvature than the rear corners 82 for keying purposes as described below. The aperture 72 from the suction inlet 62 opens into the front of the hole 78. As seen best in FIG. 2, the rear wall 86 of the hole 78 also has an aperture 84 that has the front of the inlet portion 38 thereat.

Referring also to FIGS. 5–8, the collection unit 28 is shown. The collecting unit 28 generally comprises a frame 88, a filter element 89 and a cover 90. In the embodiment shown, the frame 88 is a one-piece molded plastic or polymer member. The frame 88 has a front wall 92 with an entrance or inlet aperture 94, a generally open rear end 96, two side walls 98 with notches 100, a bottom wall 101, and a top wall 102. The frame 88 forms a cup-like shape with a debris receiving area 104 therein. Attached to the frame 88, inside the receiving area 104, is a movable flap 106. The flap 106 is connected to the front wall 92 above the entrance 94. The flap 106 hangs down over the entrance 94 to retain debris in the receiving area 104. The top wall 102 has an integral handle 108 molded therein. The top wall 102 is angled to match the angle of the top surface of the housing 18 and forms a portion of the top surface of the unit 14 as seen in FIG. 1. The notches 100 in the side walls 98 are provided to interact with cantilevered snap-lock latches 110 (see FIG. 2) (only one of which is shown) located in the side walls of the hole 78 of the housing 18. The latches 110 lock the unit 28 in the hole 78. However, the latches 110 can deflect outward when sufficient upward force is exerted on the handle 108 by the user to thereby allow the unit 28 to be removed from the housing 18. Front corners 114 of the frame 88 are suitably sized and shaped to mate with the front corners 88 of the hole 78. Similar to the hole 78, the rear corners 116 of the unit 28 have a smaller radius of curvature than the front corners 114. The rear corners 116 are suitably sized and shaped to mate with the rear corners 82 of the hole 78. The different corners function as a keying system to prevent the generally block shaped unit 28 from being inserted in the hole in a reverse position.

The rear end 96 of the frame 88 has a mounting flange 112. The flange 112 surrounds the entire rear end 96. The flange 112 is provided to allow the cover 90 to be mounted to the frame 88. The cover 90 is made of a resilient polymer material and has a general planar shape. The cover has a perimeter mount 113 with a mounting flange receiving slot 118 that receives the flange 112 therein and frictionally connects the cover 90 to the frame 88. The flange 112 has a general rectangular shape and the slot 118 has a mating rectangular shape. The cover 90 has a flat rear wall 122 with a single aperture 120 therethrough. The cover also has four spacing ribs 124 that extend from the rear wall 112 a short distance. In an alternate embodiment, more or less than four spacing ribs could be provided. The spacing ribs 124 extend radially from the aperture 120. When the cover 90 is mounted to the frame 88 it forms an air tight seal between the mounting flange 112 and the perimeter mount 113. Thus, the aperture 120 is the only passage from inside the unit 28 through the cover 90.

The filter element 89 is a single sheet of material that allows air to pass through it, but blocks dust and debris from passing through it. The filter element 89 is permanently connected to the cover 90, such as by adhesive or by welding. More specifically the perimeter of the filter element 89 is attached to the edge of the perimeter mount 113 and is also attached to the ends of the spacing ribs 124. Thus, an open space or gap 126 is established between the filter element and the rear wall 122 of the cover. Air can travel through the filter element 89 at any location (other than at connection points to the cover) into the gap 126. Once the air is in the gap 126 it can travel through the gap to the aperture 120 and out of the collection unit 28. This provides a wide area for filtering. When the cover 90 is removed from the frame 88, the filter 89 is removed with it for easy cleaning. Because the entire rear end of the frame is opened when cover 90 is removed, dumping the dust, dirt and debris from the collection unit is simple and the inside of the frame is easy to clean. When the collection unit 28 is properly positioned in the hole 78 of the housing 18, the aperture 120 is aligned with the inlet portion 38 of the shell or diffuser 36 that surrounds the impeller 26. The aperture 120 is offset from the center of the cover 90 to properly align with the inlet portion 38. To prevent the cover 90 from being attached to the frame 88 in a flipped position, wherein the aperture 120 would not align with the inlet portion 38, the upper corners 128 of the flange 112 and slot 118 have a sharp turn or radius of curvature and the lower corners 130 have a less sharp turn or radius of curvature. If the cover 90 is attempted to be connected to the frame 88 in a flipped orientation, the mismatched shapes of the intended mating corners will prevent connection in this wrong orientation. Thus, the shapes of the corners 128, 130 function as a keying means for proper connection. In an alternate embodiment, any suitable type of system could be used to connect the cover of the frame. The filter element 89 is washable. Thus, after a user removes the cover 90 to dump material from inside the unit 28, the user can wash the cover 90 to clean the filter element 89.

In operation, when a user presses the foot pedal 54 the switch 50 is actuated to turn the primary motor ON, but does not turn the brush motor 22 ON; such as for bare floors or to conserve battery power of the batteries. If the foot pedal 54 is pressed again, the switch keeps the primary motor 20 ON and also turns the second motor 22 ON. Pressing the foot pedal 54 again turns both motors OFF. The impeller 26 is revolved when the primary motor 20 is ON. This causes air and dust, dirt or debris to be sucked into the suction inlet 62 at the bottom of the unit. The air and entrained material travel through the inlet and into the collection unit 28. The air flow caused by the impeller 26 through the entrance 94 of the collection unit causes the flap 106 to move back. The large size of the received area 104 of the collection unit causes air velocity in the receiving area to be smaller than at the entrance 94. This allows the entrained dirt, dust and debris to fall into the receiving area 104. The gap 126 between the filter element 89 and rear wall 122 of the cover 90 helps to slow down the air velocity in the receiving area 104 by distributing the vacuum pull across substantially the entire surface area of the filter. Air that travels through the aperture 120 is pushed by the impeller 26 out of the housing 18 at the slots 34 in the top surface.

One of the problems in the past with rechargeable battery powered vacuum cleaners is that suction is limited because the motor that drives the impeller must be kept small in order not to drain the rechargeable batteries too quickly. The vacuum cleaner 10 overcomes this problem by the unique configuration of the housing 18 at the suction inlet 62 and at the brush 40. More specifically, the brush 40 and its pocket 46 are separated from the inlet 62 by the wall 64. This helps to keep the area of the inlet at the lower section 70 small. Thus, the vacuum pressure created by the impeller is concentrated at a small area at the bottom of the unit 14. To further assist in getting maximum vacuuming effect across substantially the entire width of the unit 14, the back to front tapering of the wall sections 76 (see FIG. 3A) and the downward tapering of the walls 67 (see FIG. 4) distribute the vacuum pressure. Thus, the vacuum cleaner 10 is able to provide good suction at the bottom of the suction inlet 62 with a relatively small motor and impeller and, also provides a motor driven rotating brush that does not significantly effect suction at the suction inlet. The brush 40 functions as an agitator. It does not propel dust, dirt or debris directly into the inlet 62. Rather, the brush propels material into the area below the inlet 62. In known old vacuum cleaners, the rotating brush was located at or connected with the suction inlet which greatly increased the size of the area of the suction inlet. This, in turn, distributed the vacuum pull over a large area and reduced its effect. The small inlet 62 with the separate and spaced pocket 46 for the brush 40 overcomes this problem.

The floor travelling head 14, in the embodiment shown, contains all of the working components of the vacuum cleaner 10 in a relatively compact footprint of about 8.5 by 11 inches. This provides a lower center of gravity and allows the head 14 to be less cumbersome to use. It also provides a short distance for debris to travel from the suction inlet into the collection unit 28. This results in less power consumption, longer running time and an overall more efficient system in view of the power being used in relation to vacuuming efficiency.

Figure 9:
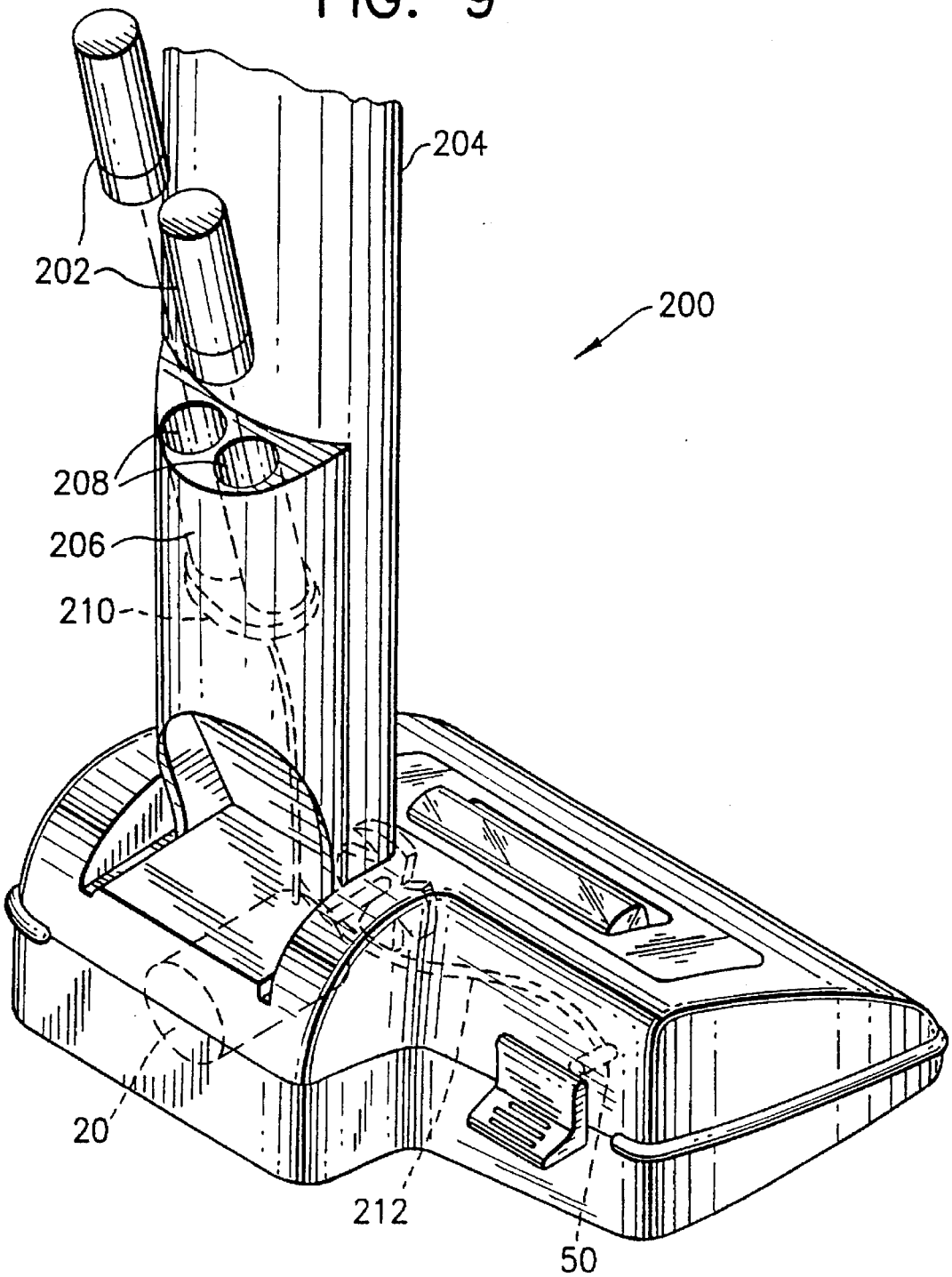
FIG. 9 is a partial rear and side perspective view of an alternate embodiment of the present invention.

Referring now to FIG. 9, there is shown a partial rear and side perspective view of an alternate embodiment of the present invention is shown. The vacuum cleaner 200 is similar to the vacuum cleaner 10. However, the vacuum cleaner 200 has two removable rechargeable batteries 202. The handle 204 has an area 206 at its bottom rear with two holes 208 and a battery terminal 210. The holes 208 are suitably sized and shaped to slidingly receive the batteries 202. The batteries can be removably inserted into engagement with the terminal 210 which act as spring clips. The batteries can be removed from the vacuum cleaner 200 for recharging in a separate battery recharger station (not shown). The terminal 210 is connected to the switch 50 by a wire 212. The switch 50, similar to the vacuum cleaner 10, is capable of supplying electricity to the primary motor 20 and the brush motor. In a preferred embodiment, the batteries 202 are VERSAPAK batteries sold by Black & Decker (US) Inc. VERSAPAK is a trademark of The Black & Decker Corporation of Towson, Md. However, any suitable type of removable rechargeable batteries could be used. This embodiment allows new recharged batteries to easily replace weak batteries very quickly such that the user does not need to wait for batteries to be recharged to use the vacuum cleaner once the in-place batteries become weak.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. In a vacuum cleaner having a housing, a motor located in the housing, an impeller connected to the motor, and a debris collection unit removably connected to the housing, the improvement comprising:

the collection unit having a frame, a cover and a filter element, the cover being removably connected to the frame to substantially close an open side of the frame, the cover having an exit aperture therethrough, and the filter element being permanently connected to an inside surface of the cover over the exit aperture;

the frame having a mounting flange surrounding the open side of the frame, the cover being mounted on the mounting flange;

the cover having a mounting flange receiving slot for receiving the mounting flange therein and frictionally connecting the cover to the frame; and said mounting flange and said slot having a generally rectangular shape, with key means to allow connection of the cover to the frame in only one position.

2. A vacuum cleaner as in claim 1 wherein the cover has spacing ribs to space the filter element from a rear wall of the cover and thereby form an open space between the filter element and the rear wall.

3. A vacuum cleaner as in claim 1 wherein the frame is a one-piece molded member with an integral handle on a top side.

4. A vacuum cleaner as in claim 3 wherein the frame has an entrance at a front side and a movable flap is connected to the frame behind the entrance.

5. A vacuum cleaner as in claim 1 said vacuum cleaner including a floor traveling unit, wherein the housing has a hole for receiving the collection unit, a top surface of the frame forming a portion of a top surface of the floor traveling unit of the vacuum cleaner.

6. A vacuum cleaner as in claim 5 wherein a side of the frame has a recess therein and the housing has a cantilevered deflectable snap-lock member located in the hole that projects into the recess to fixedly but removably mount the collection unit to the housing.

7. A vacuum cleaner as in claim 5 wherein the hole has two front corners with a first size and shape and two rear corners with a second size and shape, and the collection unit has mating corners in the hole such that the collection unit can only be inserted into the hole in a first position.

8. A vacuum cleaner collection cup assembly comprising:

a frame forming a receiving area and having a generally open rear end;

a substantially planar cover connected to the rear end of the frame, the cover substantially closing the rear end of the frame and having an exit aperture therethrough, said cover having a rear wall facing said rear end of said frame; and a flat filter element connected to an interior side of the cover, the filter element being spaced from the rear wall of the cover by spacer ribs of the cover such that air can travel through the filter element into a space between the filter element and the rear wall of the cover and through the space to the exit aperture in the cover.

9. An assembly as in claim 8 wherein the frame has a mounting flange surrounding the open rear end of the frame, the cover being mounted on the mounting flange.

10. An assembly as in claim 9 wherein the cover has a mounting flange receiving slot that receives the mounting flange therein and frictionally connects the cover to the frame.

11. An assembly as in claim 10 wherein the mounting flange and slot have a general rectangular shape with keying means to allow connection of the cover to the frame in only one position.

12. An assembly as in claim 8 wherein the frame is a one-piece molded member with an integral handle on a top side.

13. An assembly as in claim 12 wherein the frame has an entrance at a front side and a movable flap is connected to the frame behind the entrance.

14. A vacuum cleaner comprising:

a housing;

a motor located in the housing;

an impeller connected to the motor; and a collection module removably connected to the housing, the module having a combined collection assembly and filter element, the collection assembly having a frame with an entrance and a cover connected to the frame, the cover having an air exit therethrough and the filter element being permanently connected to an inside of the cover and covering the air exit, the filter element being spaced from a rear wall of the cover to form an open space between the filter element and the rear wall of the cover, the frame comprising a one piece member with an integral handle on a top side, an open rear end, and a mounting flange surrounding the open rear end.

15. A vacuum cleaner as in claim 14 wherein the cover is connected to the frame on the mounting flange, the cover having a receiving slot that receives the mounting flange and forms a frictional and air tight mounting connection therewith.

16. A vacuum cleaner as in claim 14 wherein the cover has spacing ribs on an interior side that space the filter element from the rear wall of the cover.

17. In a vacuum cleaner having a housing, a motor located in the housing, an impeller connected to the motor, and a debris collection unit removably connected to the housing, the improvement comprising:

the collection unit having a frame, a cover and a filter element, the cover being removably connected to the frame to substantially close an open side of the frame, the cover having an exit aperture therethrough, and the filter element being permanently connected to an inside surface of the cover over the exit aperture, said vacuum cleaner including a floor traveling unit, said housing having a hole for receiving the collection unit, a top surface of the frame forming a portion of a top surface of the floor traveling unit of the vacuum cleaner, a side of the frame having a recess therein and the housing having a cantilevered deflectable snap-lock member located in the hole projecting into the recess to fixedly but removably mount the collection unit to the housing.

18. In a vacuum cleaner having a housing, a motor located in the housing, an impeller connected to the motor and a debris collection unit removably connected to the housing, the improvement comprising:

the collection unit having a frame, a cover and a filter element, the cover being removably connected to the frame to substantially close an open side of the frame, the cover having an exit aperture therethrough, and the filter element being permanently connected to an inside surface of the cover over the exit aperture, said vacuum cleaner including a floor traveling unit, the housing having a hole for receiving the collection unit, a top surface of the frame forming a portion of a top surface of the floor traveling unit of the vacuum cleaner, the hole having two front corners with a first size and shape and two rear corners with a second size and shape, and the collection unit having mating corners in the hole such that the collection unit can only be inserted into the hole in a first position.

* * * * *